United States Patent [19]

Catania et al.

[11] 3,949,875

[45] Apr. 13, 1976

[54] SHAMPOO NECK STRIP

[76] Inventors: Anthony V. Catania, 134 Chatham Road; Mary H. Biviano, 125 Kent Road, both of Upper Darby, Pa. 19082

[22] Filed: Apr. 18, 1974

[21] Appl. No.: 462,129

[52] U.S. Cl. ..... 206/390; 2/50; 2/135; 2/136; 206/820

[51] Int. Cl.[2] ..... B65D 85/671; A41B 3/16

[58] Field of Search ..... 2/49 R, 50, 52, 135, 136, 2/174, DIG. 7; 206/204, 390, 820

[56] References Cited

UNITED STATES PATENTS

| | | | |
|---|---|---|---|
| 1,003,489 | 9/1911 | Moritz | 2/50 |
| 1,518,293 | 12/1924 | Zang | 2/50 |
| 2,029,417 | 2/1936 | Forster | 2/50 |
| 2,116,685 | 5/1938 | Nicolet | 2/50 |
| 2,424,680 | 7/1947 | Doyle | 2/52 |
| 2,764,501 | 9/1956 | Perri | 206/390 |
| 3,583,558 | 6/1971 | Davis | 2/49 R |
| 3,619,816 | 11/1971 | Cowen | 2/49 R |

*Primary Examiner*—William Price
*Assistant Examiner*—Bruce H. Bernstein
*Attorney, Agent, or Firm*—Seidel, Gonda & Goldhammer

[57] ABSTRACT

A multi-ply strip somewhat longer than the circumference of the average human neck has two oppositely-facing arcuate edge portions toward the center of the strip to accommodate the contours of the neck. In one form, the opposite short ends of the strip have angularly cut-off corner portions to facilitate detachment of the strip from a roll of strips.

6 Claims, 8 Drawing Figures

FIG. 1
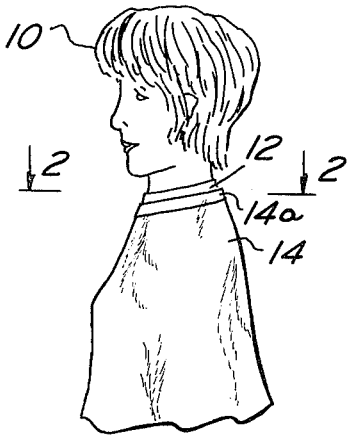
FIG. 2
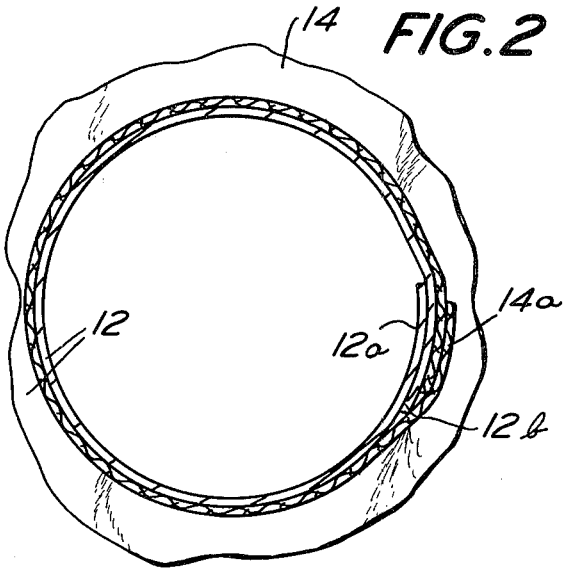
FIG. 3
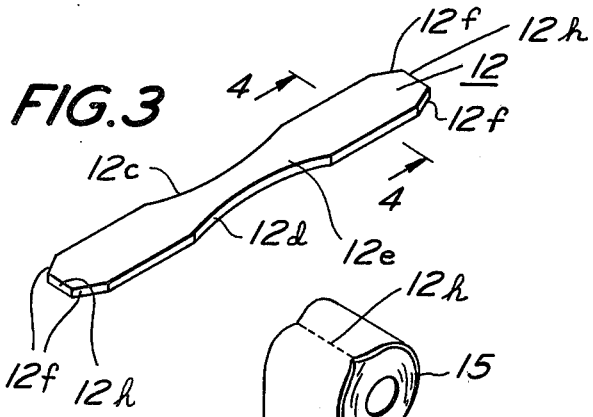
FIG. 4
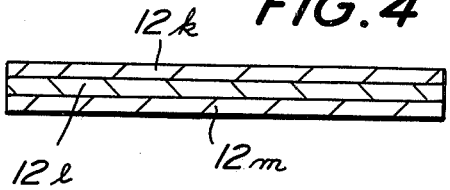
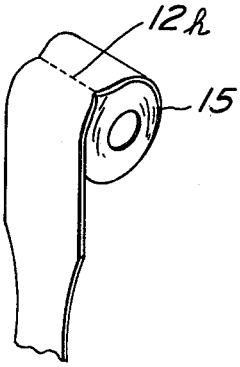
FIG. 7
FIG. 5
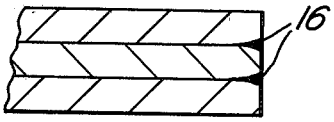
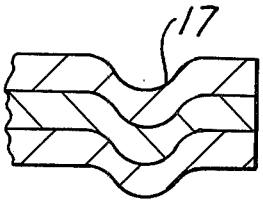
FIG. 6
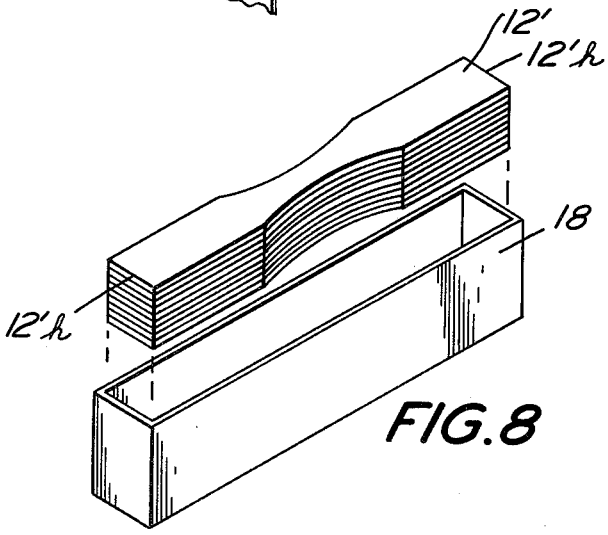
FIG. 8

SHAMPOO NECK STRIP

BACKGROUND OF THE INVENTION

1. Field of the Invention

This invention relates to hairdresser's strips designed to protect the customer's clothes during a shampoo.

2. Prior Art

Formerly, beauticians, barbers or hairdressers interposed a woven cloth towel or a paper towel between the customer's neck and the upper edge of a water-repellent or absorbent apron that was fastened by any conventional means near the nape of the neck. Because such cloth or paper towels were bulky, they often caused discomfort to the wearer especially under the chin. Also, the cost to the hairdresser of cloth towels which had to be laundered after each use became prohibitively high. Moreover, these ordinary cloth or paper towels were often so thick that the upper edge of the apron was spaced further from the neck than was desirable. In addition, these towels were, even when stored, unnecessarily bulky and space-consuming and there was no easy way to dispense them.

SUMMARY OF THE INVENTION

An elongated, multi-ply neck strip of absorbent material has two inwardly cut, arcuate edge portions toward the center thereof and a length somewhat longer than the circumference of the average human neck. The strips can be formed so that they are disposed end-to-end and joined at a weakened, perforated or scored line between two adjacent ends. This weakened line enables easy detachment of each strip from the roll. In one form, the corners of the ends are angularly cut off so that the width of the tape at the ends is smaller than elsewhere which facilitates easy detachment of the strips from a roll.

BRIEF DESCRIPTION OF THE DRAWINGS

FIG. 1 is a side elevation view of a person wearing the novel neck strip with the upper edge of the shampoo apron bearing against it on the outside;

FIG. 2 is a cross-sectional view of a portion of FIG. 1 showing the present invention in place;

FIG. 3 is a perspective view of a single neck strip in accordance with one form of the present invention;

FIG. 4 is a sectional view of the neck strip of FIG. 3 taken along the lines 4—4 in the direction indicated;

FIG. 5 is a fragmentary sectional view of an alternate form of the invention;

FIG. 6 is a fragmentary sectional view of the strip according to the present invention showing another way in which the plies may be held together;

FIG. 7 shows the strip of FIG. 3 as part of a dispensing roll before detachment; and FIG. 8 shows still another form of the novel neck strip packaged in single stacked form and insertable into an appropriate container.

DETAILED DESCRIPTION OF THE DRAWINGS

FIG. 1 shows a woman 10 wearing the novel neck strip 12 which is held in place around her neck by an apron 14. The upper edge of the shampoo cape or apron 14 is fastened at the edge portions 14*a* for example by any appropriate closure means. Such closure means could be, for example, snap-gripper means, hook-eye, or Velcro type of releasable pressure enclosure. Preferably, the cape 14 is made of a water-repellent or water-absorbent material to protect the patron's clothing. As shown in FIGS. 2 and 3, the strip 12 is an elongated composite strip which is somewhat longer than the circumference of the average adult neck. The two ends 12*a* and 12*b* of the strip overlap somewhat in the back just behind the closure portion of the cape 14. The length of the strip 12 could be, for example, on the order of 22 inches long and have a width at its widest portion at approximately 3 inches. In order to prevent bunching-up of the strip below the chin of the wearer, the strip is equipped with two inwardly facing arcuate cut-out sections 12*c* and 12*d* approximately symmetrically disposed toward the center of the length of the strip. At the narrowest portion between these arcuate cut-outs 12*c* and 12*d*, the strip could measure, for example, 1¾ inches. In the form shown in FIG. 3, the corners 12*f* of the short ends 12*g* and 12*h* of the strip 12 are angularly cut off and the junction region between adjacent ends 12*g* and 12*h* are perforated, scored or otherwise weakened. As shown in FIG. 7, these strips are packaged in a continuous roll 15 and the ends 12*h* enable easy detachment of each strip from the roll.

The composite strip 12 may be made of many selected absorbent material or materials, such as paper of the type used in paper towels or even absorbent synthetic non-woven materials. The strip consists of two or more plies 12*k*, 12*l* and 12*m* as shown in FIG. 4. The number of plies depends on the absorbency, the flexibility, the bulkiness, etc., of the material chosen. In FIG. 4, the longitudinal as well as the short edges are bonded together to keep the plies integral. In the case of absorbent plastic plies, for example, the edges could be heat-sealed. In case of the paper plies, the edges could be cemented together by an appropriate adhesive 16 as shown in FIG. 5 or, by pressure or embossing to produce the kind of seal 17 shown in FIG. 6, for example.

In FIG. 8, another form of the invention is shown in which the corners of the ends of strips 12′ are not cut off as they are stacked singly. The ends 12′*h* can be made in this form by simply shearing them.

It is seen that strips for the neck in accordance with the present invention are substantially less wasteful of paper or cloth than those bulky types of towels now conventionally folded over and used. Furthermore, the cut-out portions 12*c* and 12*d* provide the customer with much greater comfort around the neck allowing him to move his neck up or down with ease, untrammeled by over-bulky bunching of the towel in his or her neck. Since less paper stock is required and since the items are disposeable, the strips can be made available at a cheaper price than the paper towels presently pressed into service for this use. Also, the decreased bulk enables the strips to be stored and packaged in much less space and when they are in the roll form shown in FIG. 7, they are easily and conveniently dispensed one at a time.

Of course, other modifications and variations of the invention which do not depart from the spirit thereof, will occur to one upon perusal of the above specification and drawings and therefore our invention is to be limited solely by the claims which follow:

We claim:

1. A hair stylist's disposable neck strip adapted to be positioned within an apron and entirely about the human neck, comprising an elongated strip somewhat longer than the circumference of the average human neck but having a width smaller than the length of said neck, said strip including a plurality of superimposed plies all of which are made of liquid-absorbent material, said strip having opposed, inwardly arcuate sections located substantially intermediate its ends to prevent bunching of said strip, said plies being maintained in adhesion with one another.

2. The strip according to claim 1 wherein said ends are substantially transverse to the longitudinal axis of said strips.

3. The strip according to claim 1 wherein a plurality of said strips are formed in a continuous roll with weakened contiguous end portions being formed at regular intervals to enable easy detachment of the strips from the roll.

4. The strip according to claim 3 wherein the corners of each of said strips have been cut off at an angle at the junction lines of adjacent strips thereby forming a region of reduced width in said roll.

5. The strip according to claim 1 wherein said plies are made of a pulpy substance.

6. The strip according to claim 5 wherein said substance is essentially paper.

* * * * *